US010632486B2

(12) United States Patent
Schroer et al.

(10) Patent No.: US 10,632,486 B2
(45) **Date of Patent: *Apr. 28, 2020**

(54) DISPENSER ADAPTER

(71) Applicant: DDP SPECIALTY ELECTRONIC MATERIALS US, INC., Collegeville, PA (US)

(72) Inventors: Daniel R. Schroer, Midland, MI (US); Marc S. Black, Midland, MI (US); Chad V. Schuette, Midland, MI (US); Christopher J. Siler, Midland, MI (US); Daniel Ramirez, Midland, MI (US)

(73) Assignee: DDP SPECIALTY ELECTRONIC MATERIALS US, INC., Collegeville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/380,347

(22) Filed: Apr. 10, 2019

(65) Prior Publication Data

US 2019/0308210 A1 Oct. 10, 2019

Related U.S. Application Data

(60) Provisional application No. 62/655,297, filed on Apr. 10, 2018.

(51) Int. Cl.
*B05B 11/00* (2006.01)
*B65D 83/46* (2006.01)
(Continued)

(52) U.S. Cl.
CPC ..... *B05B 11/3052* (2013.01); *B05B 11/0029* (2013.01); *B65D 83/207* (2013.01);
(Continued)

(58) Field of Classification Search
CPC .... B65D 83/306; B65D 83/303; B65D 83/48; B65D 83/756; B65D 83/207; B65D 83/46; B05B 11/3053; B05D 11/0029
See application file for complete search history.

(56) References Cited

U.S. PATENT DOCUMENTS 3,506,241 A 4/1970 Ewald
4,436,229 A 3/1984 Beard
(Continued)

FOREIGN PATENT DOCUMENTS

WO 2017074756 A1 5/2017
WO 2017139128 A1 8/2017
WO 2017139131 A1 8/2017

OTHER PUBLICATIONS

International Search Report, dated Aug. 1, 2019, for corresponding International Application No. PCT/US19/26760, filed on Apr. 10, 2019.

(Continued)

*Primary Examiner* — Jeremy Carroll

(57) ABSTRACT

An article includes an adapter having a flow channel extending through it, where the adapter includes a base, a neck, a bendable segment attached to the base and neck and positioned between the base and neck, and a plunger attached to the neck or bendable segment and extending within the flow channel in the bendable segment.

10 Claims, 3 Drawing Sheets

(51) Int. Cl.

| | |
|---|---|
| ***B65D 83/20*** | (2006.01) |
| ***B65D 83/30*** | (2006.01) |
| ***B65D 83/14*** | (2006.01) |
| *B65D 83/48* | (2006.01) |

(52) U.S. Cl.
CPC ..... *B65D 83/46* (2013.01); *B65D 83/756* (2013.01); *B05B 11/3053* (2013.01); *B65D 83/201* (2013.01); *B65D 83/303* (2013.01); *B65D 83/48* (2013.01)

(56) References Cited

U.S. PATENT DOCUMENTS

| | | | | |
|---|---|---|---|---|
| 4,856,684 | A | 8/1989 | Gerstung | |
| 4,995,417 | A | 2/1991 | Naku | |
| 5,549,226 | A * | 8/1996 | Kopp | B65D 83/303 222/402.13 |
| 5,765,601 | A | 6/1998 | Wells et al. | |
| 5,850,952 | A * | 12/1998 | Morck | B65D 83/303 222/530 |
| 2007/0090133 | A1* | 4/2007 | Macleod | B65D 83/753 222/402.13 |
| 2009/0174183 | A1 | 7/2009 | Puusaag et al. | |
| 2012/0097180 | A1* | 4/2012 | Harris | B65D 83/206 132/200 |
| 2013/0167976 | A1 | 7/2013 | Vervoort et al. | |
| 2013/0320045 | A1 | 12/2013 | Hoagland et al. | |
| 2014/0224828 | A1* | 8/2014 | Demey | B05B 1/3073 222/23 |
| 2016/0223097 | A1* | 8/2016 | Demey | B65D 83/303 |

OTHER PUBLICATIONS

C. Ehrensperger AG, Ehrensperger Pageris dispenser, http://www.ehrensperger-ag.ch/en/products/aerosol-technology/dispenser/.

* cited by examiner

DISPENSER ADAPTER

BACKGROUND OF THE INVENTION

Field of the Invention

The present invention relates to an adapter to render a dispenser for a can valve that allows tilting of a valve stem to be functional with can valves that require depressing a valve stem to open.

INTRODUCTION

Dispensing fluid, particularly foamable fluid, from a compressed can is useful for many products including whipped dairy toppings and spray foam for sealing and thermal insulation applications. Foamable fluid is often available as foamable liquid under pressure in a can that is dispensed through an application tube attached to a valve or valve stem on the can. Upon release from the pressurized can the foamable liquid expands into foam.

Many types of compressed cans of fluid comprise a valve that can be opened by tilting the valve stem of the valve assembly. Examples of such valves are taught in U.S. Pat. Nos. 3,506,241, 4,436,229, and 4,856,684. Dispensers attach to the valve stem of such valves and typically tilt the valve stem to dispense can contents. Dispensers that attach to the valve stem of a valve on a can and tilt the valve stem to dispense contents of the can are the subject of numerous dispenser technologies including those disclosed in US2013/0320045, WO2017/139128 and WO2017/139131.

Dispensers designed to tilt a valve stem to dispense fluid are not suitable for use on cans that comprise a valve without a tilting valve stem assembly. For example, C. Ehrensperger AG offer PAGERIS™ valves for cans that have a valve cup around a stationary valve stem housing in which a depressible valve stem resides and that extends out from or is accessible through only the top of the valve stem housing. Such a valve assembly shall generically be called herein a "Pageris-type" valve. The stationary valve stem housing precludes tilting of the valve stem to open the Pageris-type valve. Pageris-type valves have a place in the industry that necessitates providing a dispenser for them that can readily be actuated by a single hand that is holding the can.

It would advance the art by increasing versatility of dispensers if a dispenser designed for tilting a valve stem could be used on Pageris-type valves thereby allowing one dispenser to be used on either a tilting valve stem valve or a Pageris-type valve. Then, a user could own a single dispenser and use it with a can having either type of valve. Hence, it is desirable to have an adapter that would enable a dispenser that attaches to a tilting valve stem and operates by tilting the valve stem to also function on a Pageris-type valve.

BRIEF SUMMARY OF THE INVENTION

The present invention provides an adapter that enables a dispenser that connects to a tilting valve stem and operates by tilting the valve stem to attach to a Pageris-type valve and operate as a dispenser on the Pageris-type valve. The adapter translates the tilting action of the dispenser to a compressing action required to open a Pageris-type valve as well as enables connection to Pageris-type valve.

In a first aspect, the present invention is an article comprising an adapter (10), the adapter comprising a base (20), a neck (40) and a bendable segment (30) connecting the base and the neck and having a flow channel (50) extending all the way through the base, bendable segment and neck, the adapter further comprising a plunger (60) attached to the neck or bendable segment and extending within the flow channel of the bendable segment towards and optionally into the flow channel of the base, where: (a) the base has opposing bottom (22) and top (24) ends with a base side wall (26) extending between the bottom and top with the flow channel extending through an entrance opening (23) defined through the bottom and extending between the top and bottom; (b) the bendable segment has opposing bottom (32) and top (34) ends with a bendable segment side wall (36) extending between the bottom and top with the bottom attached to the top of the base so that the flow channel extends top and bottom of the bendable segment within the bendable segment side wall, where the bendable segment side wall comprises a compressible feature (38); (c) the neck has opposing bottom (42) and top (44) ends with a neck side wall (46) extending between the bottom and top with the bottom attached to the top of the bendable segment so that the flow channel extends between the top and bottom of the neck, within the neck side wall and through an exit opening (45) defined through the top of the neck; and (d) the plunger is of dimensions and/or design so as to allow fluid communication around and/or through it within the flow channel; wherein the flow channel extends in a straight line from the entrance opening of the base through the exit opening of the neck when in its neutral position. The article can further comprise a can (100) and/or dispenser (200). The can has a valve (110) that comprises a valve cup (120) around a stationary valve stem housing (130) in which a depressible valve stem (140) resides and that extends out from or is accessible through only a top side (132) of the valve stem housing and where the adapter is attached to the can such that the base of the adapter is fit within the valve cup with the stationary valve stem housing and valve stem extending through the entrance opening in the base of the adapter into the flow channel of the adapter, and further characterized by the plunger extending far enough down in the flow channel so as to depress the valve stem and open the valve when the bendable segment of the adapter is tilted to its tilted position relative to the base and yet not so far so as to depress the valve stem and open the valve when the bendable segment of the adapter is in its neutral position. The dispenser is attached to the adapter, the dispenser having a flow channel (210) therethrough from an entrance end (220) to an exit end (230) and that is removably attached to the neck of the adapter at the dispenser's entrance end, where threads (48) are defined on the outside of the adapter neck side wall that are engaged with mating threads (240) defined on the inside of the dispenser within the flow channel proximate to the entrance end of the dispenser.

The present invention is useful for adapting a tilting valve stem dispenser to a Pageris-type valve for dispensing fluid from a compressed can.

DETAILED DESCRIPTION OF THE INVENTION

"And/or" means "and, or alternatively". All ranges include endpoints unless otherwise stated. "Multiple" means more than one. "Fluid" refers to a substance that has no fixed shape and yields to external pressure and includes gas, liquid, and gas or liquid continuous formulations. Typically, though not necessarily, fluid refers to liquid and liquid continuous formulations as used herein.

Unless otherwise indicated in the context of its usage herein, orientation references are in reference to the direction of fluid flow from the can of the article through the dispenser flow channel as described in this paragraph. Terms referring to an elevated position of an element such as "top" or "above" refer to the portion of the element furthest along the direction of fluid flow. Terms referring to an elevating direction such as "up" refers to the direction of fluid flow. Terms referring to a subordinate position of an element such as "bottom" or "below" refer to the portion of the element least far along the direction of fluid flow. Terms referring to a subordinate direction such as "down" refer to the opposite direction of fluid flow.

The following description makes reference to FIGS. 1-4 to facilitate understanding. However, for avoidance of any doubt, the FIGS. 1-4 do not illustrate the full breadth of the invention but only embodiments of the elements of the invention to illustrate how they can fit together or be manifest. For avoidance of doubt, the broadest scope of the invention is intended to allow for embodiments of components as taught herein to be combined in any way physically allowable within the scope of the teaching and not be specifically limited to that illustrated in FIGS. 1-4. However, FIGS. 1-4 do illustrate embodiments of the invention.

The following description generally identifies the element number from the Figures only with the first mention of the element for the sake of easier reading.

Figure 1:
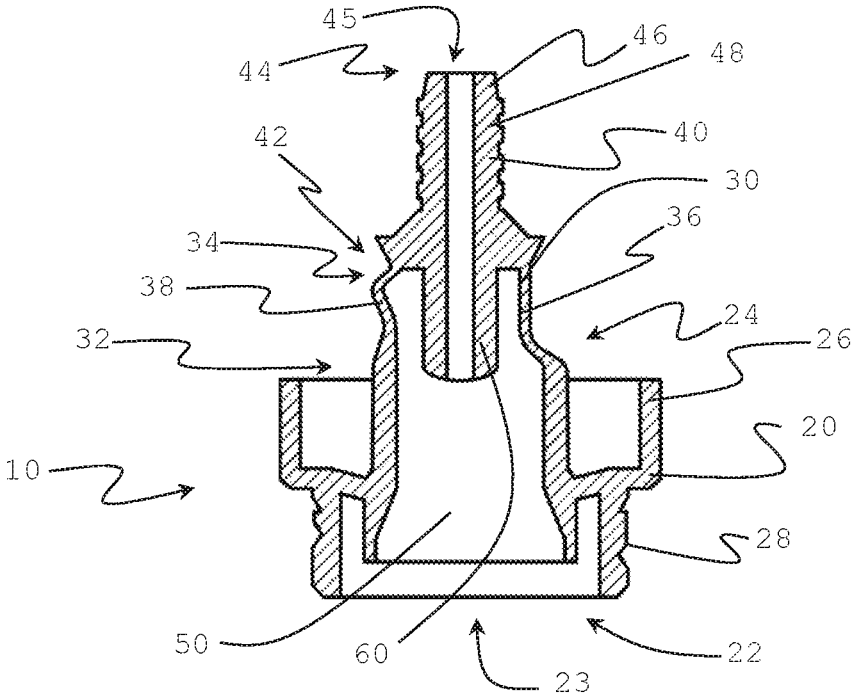
FIG. 1 illustrates a side cut-away view of an adapter of the present invention.
Figure 2:
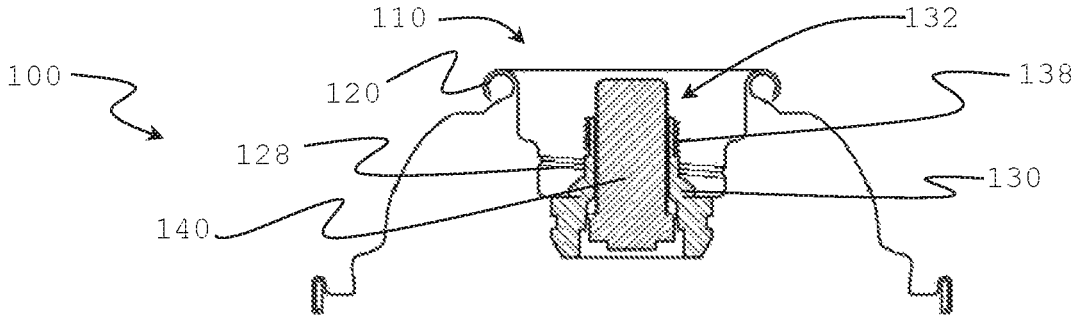
FIG. 2 illustrates a side cut-away view of the top of a can comprising a Pageris-type valve.

The adapter (10) comprises a base (20), a neck (40) and a bendable segment (30) that connects the base and the neck. A flow channel (50) extends all the way through the adapter, preferably in a straight line, extending through the base, bendable segment and neck. FIG. 1 illustrates an adapter of the present invention.

The base has opposing bottom (22) and top ends (24) with a base side wall (26) extending between the bottom end and top end. The bottom has an entrance opening (23) defined therethrough. The flow channel extends through the entrance opening through the base through to the top of the base. The base side wall defines the flow channel through the base with the "inside" of the base side wall exposed within the flow channel and the "outside" of the base side wall external to the flow channel. The base side wall can have threads (28) defined on the outside (outer surface) of the base side wall.

The bendable segment (30) has opposing bottom (32) and top (34) ends with a bendable segment side wall (36) extending between the top end and bottom end. The flow channel extends all the way through the bendable segment, between the top and the bottom. The bendable segment is attached proximate to the bottom end of the bendable segment to the base proximate to the top end of the base such that there is fluid communication within the flow channel from the base through the bendable segment. The bendable segment and base can attach such that the top of the base and bottom of the bendable segment coincide. It is also conceivable that the bendable segment slips over a portion of the base (or vice versa) such that the top of the base is between the top and bottom of the bendable segment.

The bendable segment side wall comprises a compressible feature (38). The compressible feature enables the bendable segment to reversibly tilt with respect to the base. Examples of suitable compressible features include one or more than one indentation in the bendable segment side wall, one or more fold in the bendable segment side wall, or a corrugated section of the bendable segment side wall. The bendable segment has a neutral position at which the flow channel extends in a straight line through the adapter. The compressible feature enables the bendable segment to reversibly tilt from the neutral position to a position where the flow channel bends from a straight line in or at the bendable segment.

The neck (40) has opposing bottom (42) and top (44) ends with a neck side wall (46) extending between the bottom and top ends. An exit opening (45) extends through the top end. The flow channel extends all the way through the neck between the bottom and the top such that the flow channel has fluid communication from the entrance opening of the base through the exit opening of the neck. The neck is attached such that the bottom end of the neck attaches to the bendable segment proximate to the top end of the bendable segment. The neck and bendable segment can attach such that the top of the bendable segment and bottom of the neck coincide. It is also possible that the neck slips over a portion of the bendable segment (or vice versa) such that the top of the bendable segment is between the top and bottom of the neck. The neck can have threads (48) defined on the outside (on the outer surface) of the neck side wall. Such threads are useful for screwing onto the neck of a dispenser in order to attach the dispenser to the adapter as described herein below.

The plunger (60) is attached to the neck and/or the bendable segment and extends within the flow channel of the bendable segment towards and optionally into the flow channel of the base. The plunger can be attached to the inside of the side wall of the neck and/or bendable segment and extend into a flow channel. The plunger can be an extension of the wall of the neck that extends into a larger diameter flow channel of the bendable segment, as shown in the adapter of FIGS. 1, 3 and 4. When the bendable segment is tilted with respect to the base the plunger extends further down along the flow channel of the adapter towards the entrance opening of the base. When the bendable segment is returned from a tilted position to its neutral position the plunger retracts upward in the flow channel away from the entrance opening of the base.

Figure 3A:
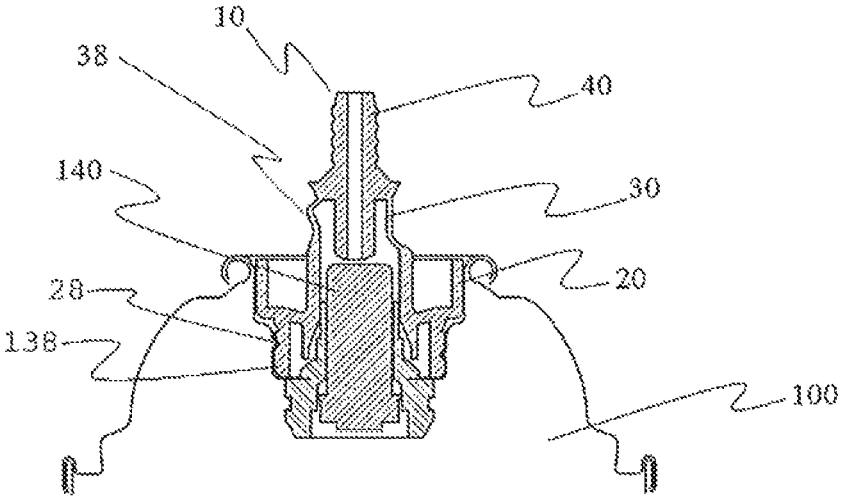
FIG. 3A illustrates a side cut-away view of the adapter of FIG. 1 attached to the valve of the can in FIG. 2 and in the neutral position of the bendable segment of the adapter.
Figure 3B:
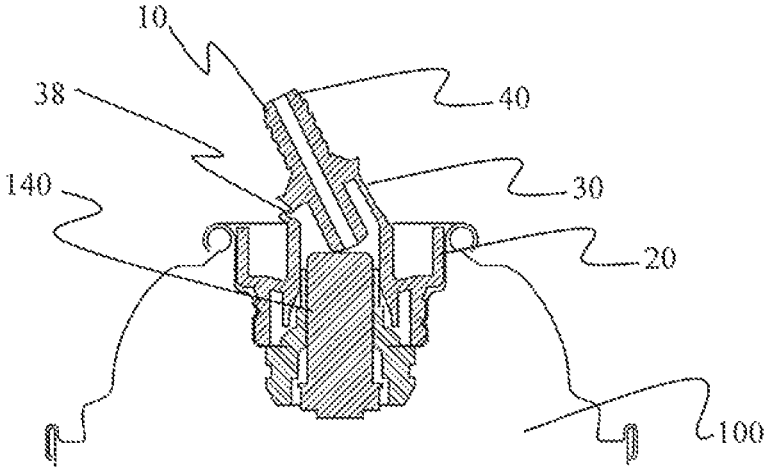
FIG. 3B illustrates a side cut-away view of the adapter of FIG. 1 attached to the valve of the can in FIG. 2 and in a tilted position of the bendable segment of the adapter.

FIGS. 3A and 3B illustrate an adapter attached to the valve of a can with the adapter in the neutral position (FIG. 3A) and tilted position (FIG. 3B) to show how the plunger can depress the valve stem when the adapter is in the tilted position but not when in the neutral position. It is evident in the FIGS. 3A and 3B the role of the compressible feature of the bendable segment in enabling the bendable segment to tilt with respect to the base. In FIGS. 3A and 3B the compressible feature is a corrugated section of the side wall that compresses when in the tilted orientation shown in FIG. 3B.

The plunger is of dimension and/or design so as to allow fluid communication around and/or through it within the flow channel. The dimensions of the plunger can be such that there is fluid communication around the plunger within the flow channel. Alternatively, or at the same time, the design of the plunger can be such that it has a hole or holes defined through it to allow fluid communication through the plunger in the flow channel. For example, the plunger can appear as an extension of the neck side wall and have the flow channel of the adapter extending through the plunger between the bendable segment and neck (as shown in FIGS. 1, 3 and 4).

The adapter is typically free of a trigger feature protruding radially out from the adapter relative to a line defined by the flow channel when the bendable segment is in its neutral position.

The adapter can attach to a Pageris-type valve of a can. The article of the present invention may comprise the adapter attached to a can (100), like the one shown in FIGS. 2-4, having a Pageris-type valve, which is a valve (110) that comprises a valve cup (120) around a stationary valve stem housing (130) in which a depressible valve stem (140) resides. The depressible valve stem extends out from the top (132) of the stationary valve stem housing or is accessible within the valve stem housing through the top of the valve stem housing. The stationary valve stem housing is typically a cylindrical structure. The stationary valve stem housing is rigidly attached to the valve cup so that it cannot tip, bend or compress relative to the valve cup. It serves the purpose of protecting the valve stem from accidentally being depressed. Depressing the valve stem (that is, displacing the valve stem towards the can within the valve stem housing) opens the valve and provides fluid communication from inside the can to outside the can, releasing pressurized fluid that is within the can. When the valve stem is depressed so as to open the valve then the valve and valve stem are in an "open position", otherwise they are in a "closed position". When the valve stem is in the closed position the can is sealed shut. Typically, the pressure from the can, or an elastic element (such as a spring) between the valve cup and valve stem keeps the valve stem in a closed position until actively depressed to the open position.

The article that further comprises the can has the adapter attached to the can with the base of the adapter fit within the valve cup with the stationary valve stem housing and valve stem extending through the entrance opening in the base of the adapter into the flow channel of the adapter. The plunger extends far enough down into the flow channel towards the entrance opening of the base to cause the plunger to depress the valve stem of the can and open the valve when the bendable segment is tilted from its neutral position, yet does not extend so far down into the flow channel towards the entrance opening of the base when the bendable segment is in its neutral position to depress the valve stem sufficiently to open the valve of the can. Hence, the valve of the can remains closed when the bendable segment is in its neutral position but open when the bendable segment is tilted relative to the base from its neutral position.

To facilitate secure attachment of the adapter to the can, the valve can comprise threads that mate with threads on the base of the adapter thereby allowing the adapter to screw onto the valve. For example, the valve cup can have threads (128) that mate with threads (28) defined on the outside of the base wall. Such mating threads enable the adapter and valve to engage and mate upon screwing the adapter onto the valve and hold the adapter onto the valve. Alternatively, or in addition, threads may be provided on the inner surface of the base wall, and mate with threads on the outer surface of the stationary valve stem housing (138).

The base of the dispenser desirably is free of any portion that fastens to the valve cup of the can by extending over the top of the valve cup, for example clipping onto the valve cup over the top of the valve cup.

Figure 4A:
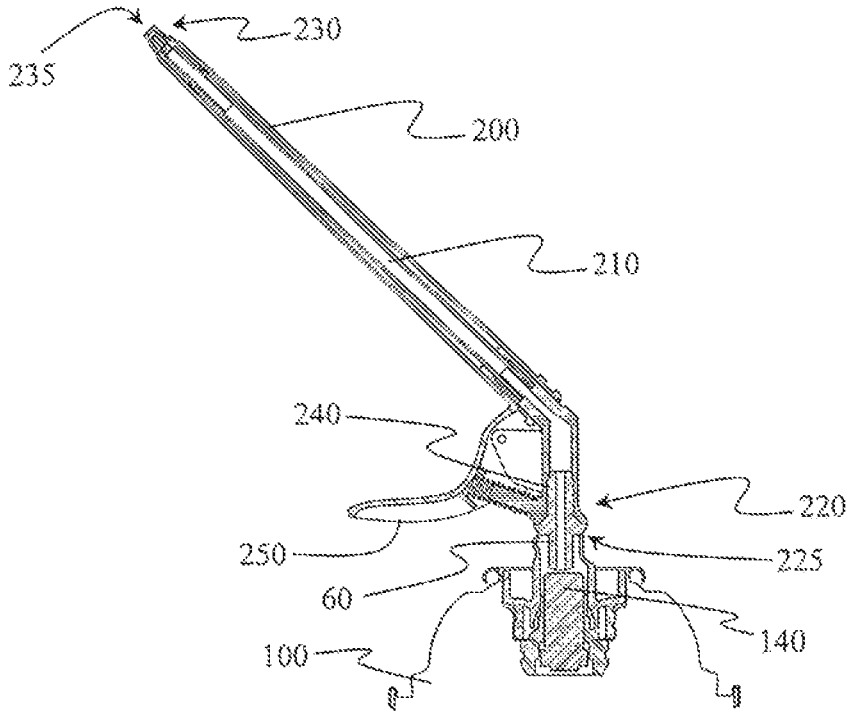
FIG. 4A illustrates a side cut-away view of the adapter of FIG. 1 attached to the valve of the can in FIG. 2 with a dispenser attached to the adapter and with the bendable segment of the adapter in the neutral position.
Figure 4B:
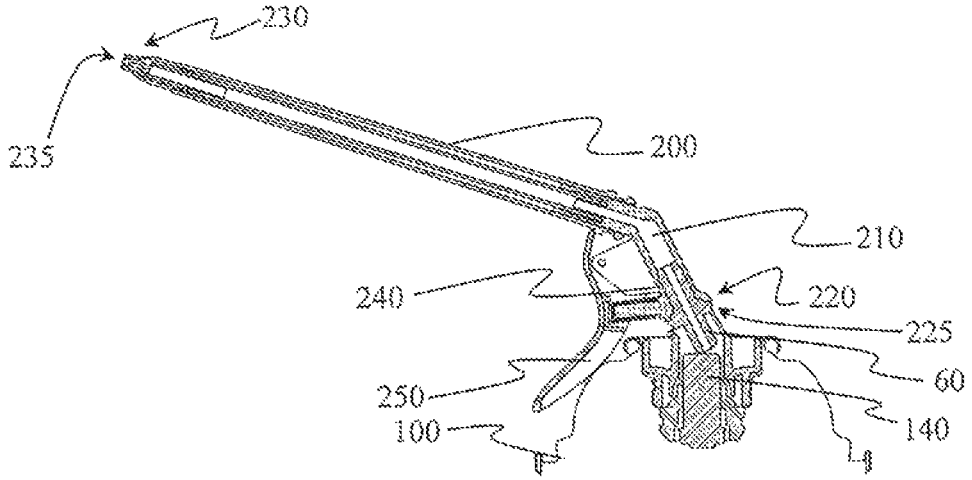
FIG. 4B illustrates a side cut-away view of the adapter of FIG. 1 attached to the valve of the can in FIG. 2 with a dispenser attached to the adapter and with the bendable segment of the adapter in a tilted position.

The article of the present invention can comprise a dispenser (200) attached to the adapter in addition to, or as an alternative to, having a can attached to the adapter. FIGS. 4A and 4B show a can with the adapter attached to the valve of the can and a dispenser attached to the adapter, with the adapter in the neutral position and tilted position, respectively. The dispenser has an entrance end (220) and an exit end (230). An entrance opening (225) extends through the entrance end and into a flow channel (210) that extends all the way through the dispenser and through an exit opening (235) that extends through the exit end. The dispenser is removably attached to the adapter. Desirably, the neck of the adapter extends through the entrance end of the dispenser into the flow channel of the dispenser so that the flow channel of the adapter is in fluid communication with the flow channel of the dispenser. The neck of the adapter can have threads (48) defined on the outside (i.e. on the outer surface) of the neck side wall that engage with mating threads (240) defined on the inside of the dispenser (that is, within the flow channel) proximate to the entrance opening so that the adapter can be screwed onto and off from the adapter. The dispenser can have a trigger protrusion (250) extending radially relative to its flow channel.

What is claimed is:

1. An article comprising an adapter (10), the adapter comprising a base (20), a neck (40) and a bendable segment (30) connecting the base and the neck and having a flow channel (50) extending all the way through the base, bendable segment and neck, the adapter further comprising a plunger (60) attached to the neck or bendable segment and extending within the flow channel of the bendable segment towards and optionally into the flow channel of the base, where:

(a) the base has opposing bottom (22) and top (24) ends with a base side wall (26) extending between the bottom and top with the flow channel extending through an entrance opening (23) defined through the bottom and extending between the top and bottom;

(b) the bendable segment has opposing bottom (32) and top (34) ends with a bendable segment side wall (36) extending between the bottom and top with the bottom attached to the top of the base so that the flow channel extends top and bottom of the bendable segment within the bendable segment side wall, where the bendable segment side wall comprises a compressible feature (38);

(c) the neck has opposing bottom (42) and top (44) ends with a neck side wall (46) extending between the bottom and top with the bottom attached to the top of the bendable segment so that the flow channel extends between the top and bottom of the neck, within the neck side wall and through an exit opening (45) defined through the top of the neck; and (d) the plunger is of dimensions and/or design so as to allow fluid communication around and/or through it within the flow channel;

wherein the flow channel extends in a straight line from the entrance opening of the base through the exit opening of the neck when in its neutral position.

2. The article of claim 1, wherein the adapter is free of a trigger feature protruding radially out from the adapter relative to a line defined by the flow channel when the bendable segment is in its neutral position.

3. The article of claim 1, wherein the base has threads (28) defined on an outer surface of the base side wall; defined on an inner surface of the base side wall within the flow channel proximate to the entrance opening of the base; or defined on the outer surface of the base side wall and on the inner surface of the base side wall within the flow channel proximate to the entrance opening of the base.

4. The article of claim 1, wherein the neck has threads (48) defined on an outer surface of the neck side wall.

5. The article of claim 1, wherein the compressible feature defined in the bendable segment side wall is a corrugated section of the bendable segment side wall.

6. The article of claim 1, wherein the article further comprises a can (100) having a valve (110) that comprises a valve cup (120) around a stationary valve stem housing (130) in which a depressible valve stem (140) resides and that extends out from or is accessible through only a top side (132) of the stationary valve stem housing and where the adapter is attached to the can such that the base of the adapter is fit within the valve cup with the stationary valve stem housing and depressible valve stem extending through the entrance opening in the base of the adapter into the flow channel of the adapter and further characterized by the plunger extending far enough down in the flow channel so as to depress the depressible valve stem and open the valve when the bendable segment of the adapter is tilted to its tilted position relative to the base and yet not so far so as to depress the depressible valve stem and open the valve when the bendable segment of the adapter is in its neutral position.

7. The article of claim 6, wherein the adapter base attached to the valve is free of any portion that fastens to the valve cup by extending over the top of the valve cup.

8. The article of claim 6 or 7, wherein the base of the adapter has threads (28) defined on an outer surface of the base side wall that engage mating threads (128) in the valve cup.

9. The article of claim 1, wherein the article further comprises a dispenser (200) attached to the adapter, the dispenser having a flow channel (210) therethrough from an entrance end (220) to an exit end (230) and that is removably attached to the neck of the adapter at the entrance end of the dispenser, where threads (48) are defined on an outer surface of the adapter neck side wall that are engaged with mating threads (240) defined on an inner surface of the dispenser within the flow channel proximate to the entrance end of the dispenser.

10. The article of claim 9, wherein the dispenser comprises a trigger protrusion (250) extending radially relative to its flow channel.

* * * * *